US005397153A

United States Patent [19]

Dutaut et al.

[11] Patent Number: 5,397,153

[45] Date of Patent: Mar. 14, 1995

[54] COMPETITION SKI DESIGNED FOR SLALOM AND END-PIECE DESIGNED FOR SAID SKI

[75] Inventors: Jean-Luc Dutaut, Ugine; Axel Phelipon, Annecy, both of France

[73] Assignee: Salomon S.A., Chavanod, France

[21] Appl. No.: 66,419

[22] Filed: May 25, 1993

[30] Foreign Application Priority Data

May 25, 1992 [FR] France ..... 92 06525

[51] Int. Cl.[6] ..... A63C 5/04

[52] U.S. Cl. ..... 280/809; 280/608; 280/609

[58] Field of Search ..... 280/608, 609, 809, 601, 280/602

[56] References Cited

U.S. PATENT DOCUMENTS 4,616,842 10/1986 Echevin et al. ..... 280/809
4,861,063 8/1989 Abondance ..... 280/809
5,292,146 3/1994 Palau ..... 280/809

FOREIGN PATENT DOCUMENTS 331696 8/1976 Australia .
0168579 1/1986 European Pat. Off. .
4101915 8/1991 Germany .
595118 1/1978 Switzerland .

*Primary Examiner*—Richard M. Camby
*Attorney, Agent, or Firm*—Pollock, Vande Sande & Priddy

[57] ABSTRACT

Slope ski specially adapted to slalom and comprising a central down-side load-bearing portion (10) ending in a front contact line (12) beyond which is extended, in the area of the tip (2), a raised up-side portion (11) on which is mounted an asymmetrical tip end-piece (3) which extends the raised part through a central part (4) having the overall shape of a horn whose tip (34) is offset to the inside of the ski (INT) in relation to the median longitudinal axis (I, I'). The end-piece comprises an overhanging lateral part (5) connecting with the central part and constituting a skirt for the side of the outer edge of the ski and whose upper surface (50) is designed to come into contact with the pole. The invention also relates to the deflector end-piece designed to be mounted on a ski. The invention allows the ski tip to remain in continuous contact with the snow, even in the event of contact of the skirt (5) with the slalom pole (24).

3 Claims, 3 Drawing Sheets

COMPETITION SKI DESIGNED FOR SLALOM AND END-PIECE DESIGNED FOR SAID SKI

Field of the Invention

The present invention concerns a competition ski, and, more specifically, a ski designed for special slalom. In this type of competition, the racer is called on to cross at high speed very closely-spaced gates, each of which is delimited by two poles of the same color. This event calls for very high levels of drive, judgment and the ability to react. One of the major difficulties lies in avoiding straddling the interior pole while turning, at the same time communicating to the tip of the inner ski a trajectory which passes as close as possible to the pole. Any error in trajectory irreparably causes the fall and disqualification of the racer.

BACKGROUND OF THE INVENTION

To increase the racer's chances of crossing the gates, provision was made to mount, on the end of the ski tip or on a raised part, partially or entirely truncated, a raised, curved horn-shaped piece whose asymmetrical configuration extends the ski and shifts the point of the tip toward the outside of the turn. A device of this kind is described in Patent No. CH 504 214, for example. French Patent No. 2 617 729 proposes an improvement consisting in extending the mounted piece forward by a part which overhangs the raised portion to which it is attached.

All devices according to prior art have contributed imperfect solutions to the technical problem thus posed. The asymmetry effect has in fact made it possible to shift advantageously the point of the tip to the outside of the turn and to increase the safety margin, by increasing the distance of the tip from the pole. On the other hand, impact of the piece against the pole causes, in most cases, the inner ski to rise up in the turn, leading to loss of traction of the ski on the snow and to loss of support for the racer in the turn. The crossing of the skis and the imbalance of the racer are the immediate and inescapable consequences of this kind of error.

SUMMARY OF THE INVENTION

The invention is intended to solve this problem by proposing an asymmetrical end-piece incorporating a new shape and design. During impact with the pole, the ski equipped with this piece remains in contact with the snow and generates only slight lateral movement, which proves inconsequential. Thus, the racer's safety margin increases further and promotes completion of the run.

To this end, the object of the invention is a ski for use on slalom slopes, comprising a down-side central load-bearing part ending in a front contact line, beyond which is extended, in the area of the tip, an up-side raised part on which is mounted an asymmetrical tip end-piece which extends the raised part by means of a central portion whose overall shape is that of a horn, the tip of which is located on a longitudinal axis offset to the inside in relation to the median longitudinal axis of the ski. The end-piece comprises a lateral overhanging portion which attaches to the central portion and forms a skirt for the side of the outer edge of the ski and whose upper surface is designed to come into contact with the pole.

The skirt is preferably shaped in such a way that the normal line, marked out at any point on the upper surface of this skirt, forms a positive, non-nil angle with a plane parallel to the ground, when the ski is inclined to the outside by an angle of between approximately 15° and 45° when the ski edge digs into the snow. Accordingly, any impact of the skirt against the pole generates a reaction force whose vertical component is directed downward, thereby keeping the tip of the ski in constant contact with the snow.

The invention also relates to the asymmetrical pole-deflector end-piece which can be fitted on a slope ski and which comprises a first central part shaped generally like a horn and whose tip is located on a longitudinal axis offset in relation to the median longitudinal axis of the ski, and a second, lateral overhanging part constituting a skirt connecting on the largest of the inward-curved sides of the first central part.

BRIEF DESCRIPTION OF THE DRAWINGS

Other advantages and features will emerge from the following description of invention examples.

DESCRIPTION OF PREFERRED EMBODIMENT

Figure 1:
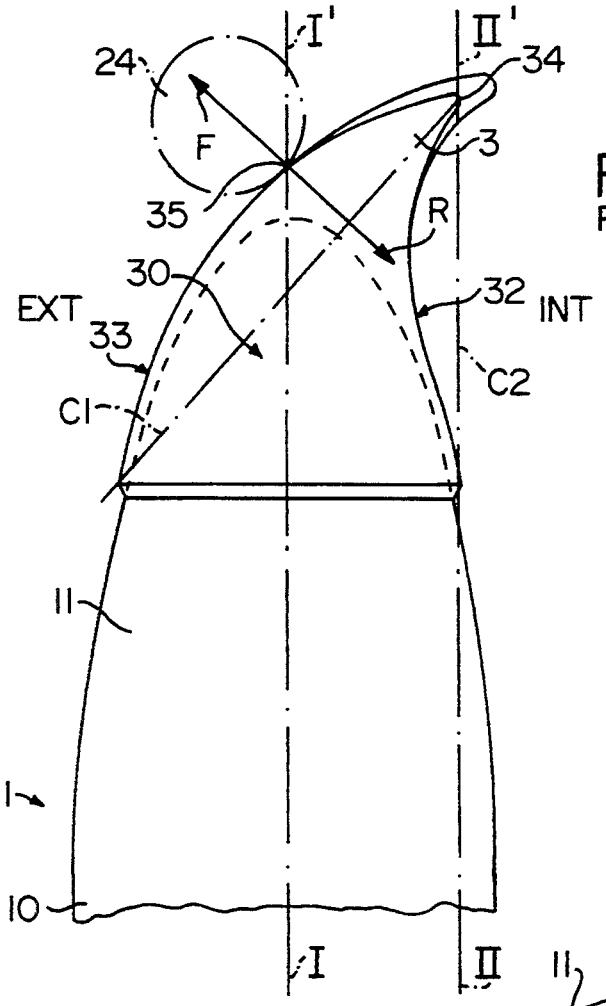
FIG. 1 PRIOR ART
FIG. 1 is a top plan view of the front part of a prior art ski (left) equipped with a conventional tip end-piece.
Figure 2:
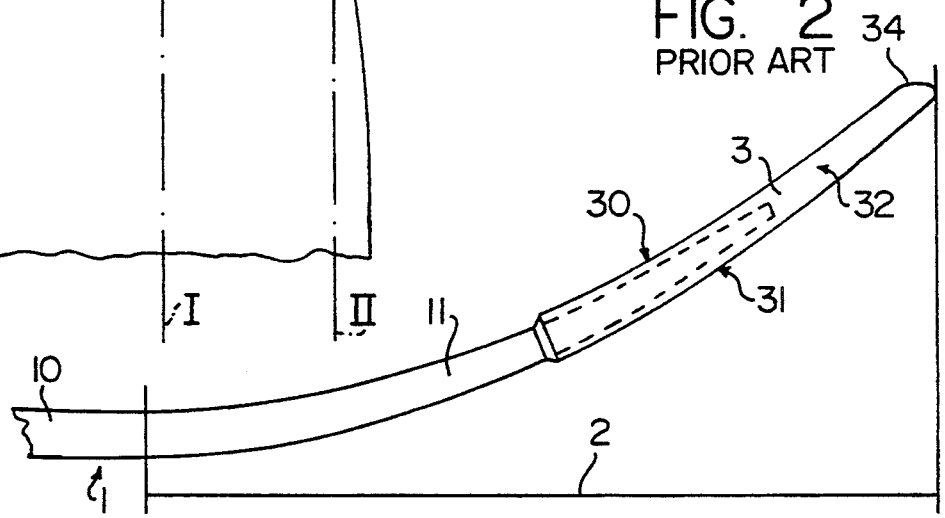
FIG. 2 PRIOR ART
FIG. 2 is a side view of the front part of the ski in FIG. 1.
Figure 3:
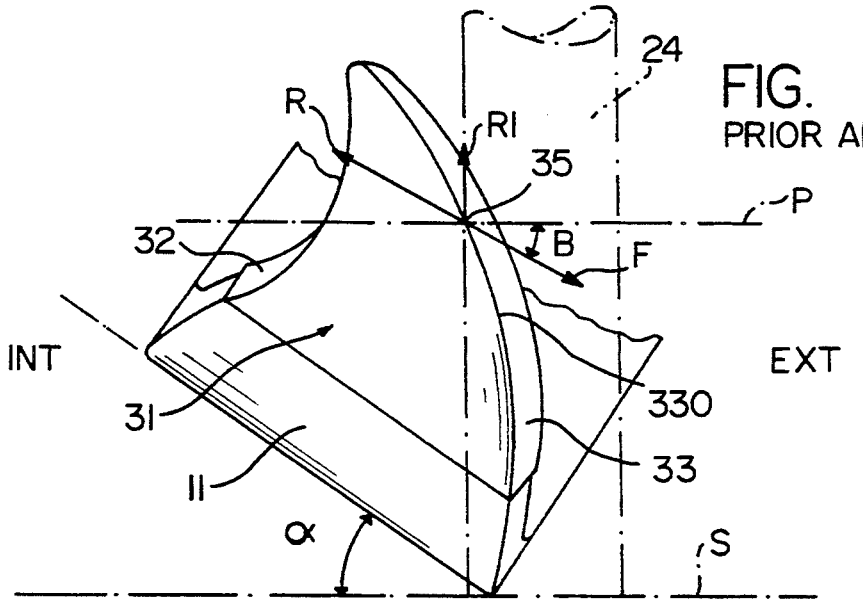
FIG. 3 PRIOR ART
FIG. 3 is a front view of the ski in FIGS. 1 and 2, during the execution of a turn in order to pass a gate.

FIG. 1 illustrates the front of a left ski according to prior art and incorporating a conventional asymmetrical end-piece. The ski 1 comprises a down-side central portion 10 constituting the load-bearing area, and an up-side raised part 11 constituting a portion of the tip area 2. The up-side part 11 is extended in unbroken fashion by an asymmetrical end-piece 3 whose profile is slightly curved inward and upward. The end-piece comprises an upper and a lower surface 30 and 31 respectively whose general shape is that of a horn and which are connected by an inward-curved outer edge 33 corresponding to chord C1 and an inward-curved inner edge 32 corresponding to chord C2, which is smaller than C1. The edges 32, 33 meet at the tip 34 of the end-piece located on an axis (II, II') which is offset to the inside (INT) in relation to the median longitudinal axis (I, I') of the ski. The advantage of this construction is that, as shown in FIG. 3, it makes it possible to increase the safety distance by shifting the end 34 of the tip to the inside so as to facilitate moving past the pole 24. During the turn, the outer edge of the ski is dug into the snow and the ski is inclined to the inside of the turn by a certain angle $\alpha$, generally of between 15° and 45°. If the path of the ski is such that the front end strikes the pole 24, the impact occurs at a point 35 located on the outer edge 33 and, more particularly, in proximity to the lower edge 330 connecting the outer edge 33 to the lower surface 31 of the end-piece, by virtue of the inward, upward curvature of the end-piece. Accordingly, the force of the ski is directed toward the outside (EXT, or inside of the turn) and downward. The reaction R thus generates a vertical component R1 directed upward, which thus tends to raise the end of the ski and cause it to lose traction on the snow. This phenomenon is especially intensified because, under dynamic behavior, the pole bends slightly when the ski passes and slides along the lower edge 330, thus creating an inclined surface effect which gradually disengages the ski.

Figure 4:
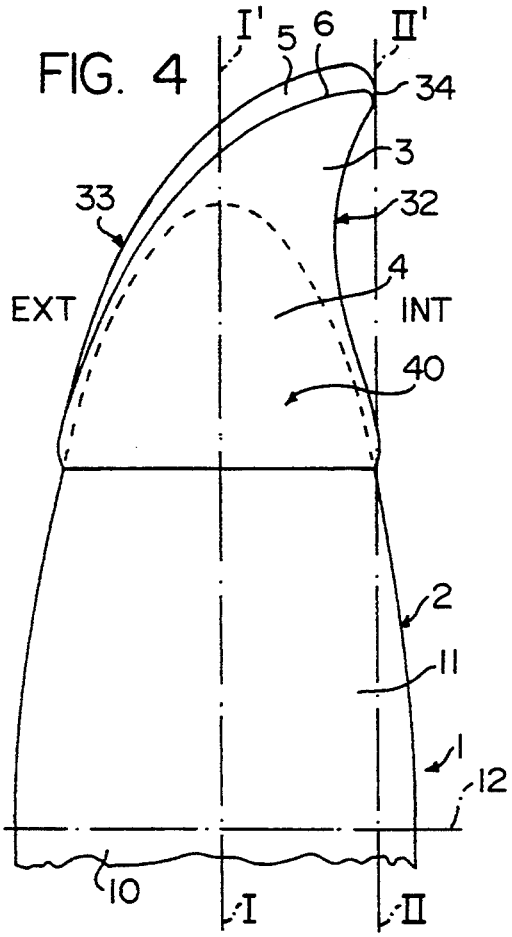
FIG. 4 is a top plan view of the front part of a ski (left) according to the invention.

FIG. 4 illustrates the front of a ski (left) according to the invention, which also comprises a central down-side portion 10 constituting the load-bearing area, and a substantially raised up-side portion 11 constituting, at least partially, the tip 2. The two portions are demarcated by a contact line 12. An end-piece 3 is mounted on the up-side portion 11 and extends it. This end-piece 3 comprises a first central portion 4 formed by an upper surface 40 and a lower surface 41 whose overall shape is that of a horn. The upper and lower surfaces 40 and 41 are connected by an inner edge 32 which curves inward on the inner side of the ski, and they meet toward the front at a tip 34 located on a longitudinal axis (II, II') offset to the inside (INT, or outside of the turn) in relation to the median longitudinal axis (I, I') of the ski. 0n the outer edge of the ski, the central portion 4 connects with a second lateral overhanging portion constituting a skirt and extending the upper and lower surfaces 40 and 41. The two portions 4 and 5 may be delimited by an upper edge 6 which is more or less well-defined, as shown. However, a gradual transition is provided from one portion to the other, by means of a substantially rounded and more aesthetically-pleasing zone.

Figure 7:
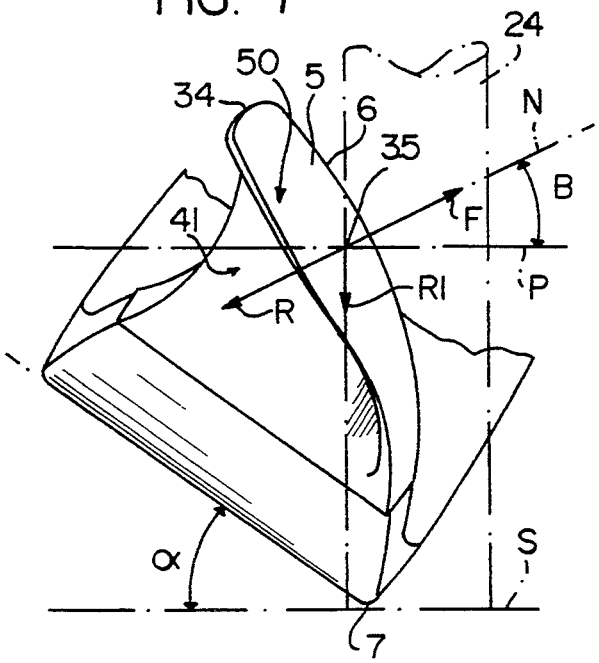
FIG. 7 is a front view of the ski in FIGS. 4 to 6 when executing a turn in order to pass a gate.
Figure 5:
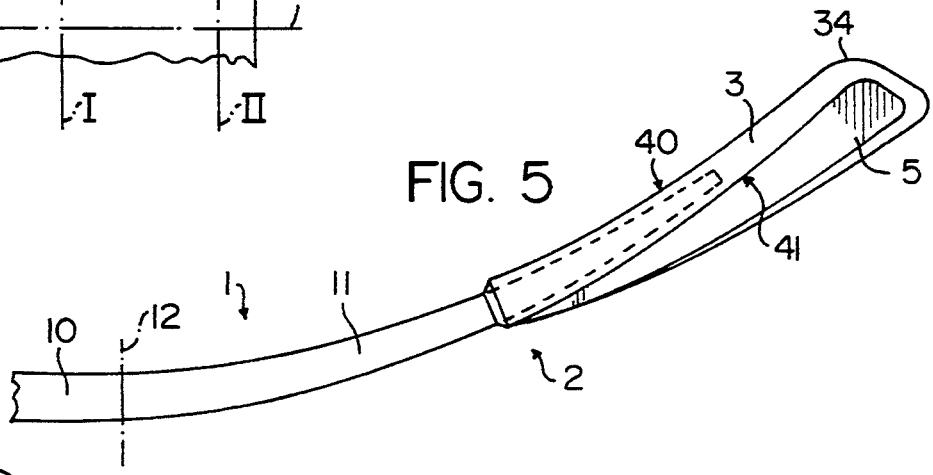
FIG. 5 is a view of the inner side of the ski in FIG. 4.
Figure 6:
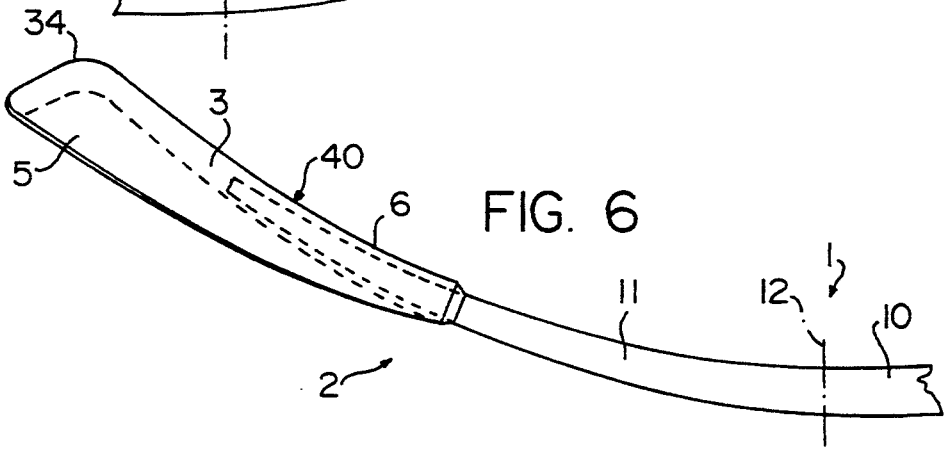
FIG. 6 is a view of the outer side of the ski in FIG. 4.

As shown more particularly in FIG. 7, the skirt 5 is shaped in such a way that the normal line marked out at all points on its upper surface 50 forms a positive, non-nil angle $\beta$ with a plane (P) parallel to the ground (S) when the ski is inclined to the outside by a certain angle $\alpha$ more particularly ranging between 15° and 45°. Thus, when the pole 24 comes into contact with the end-piece 3, the point of impact 35 falls on the upper surface 50 of the skirt 5. The vertical resultant R1 of the reaction force R of the pole, whose point of application of force is a point of impact 35 which may be located at any point whatever on the upper surface 50, is directed downward, thus tending to press the ski, and, more particularly, the outer edge 7, down on the snow. In the dynamic behavior mode, the point of application of force 35 of the pole on the end-piece moves along the upper surface 50 when the ski moves forward, thereby generating forward flection of the pole, but the resultant R1 remains always directed downward. The inclined surface effect thus acts on the upper surface 50 of the skirt 5, so as to disengage the tip of the ski from the pole while preserving perfect traction of the edge 7 on the snow.

The cut of the lateral part, or skirt 5, may be progressive. However, advantage may be gained by providing for a greater width toward the front of the end-piece, then a gradual reduction toward the rear, so that the lateral edges of the end-piece can connect substantially continuously with the lateral edges of the ski.

Figure 8:
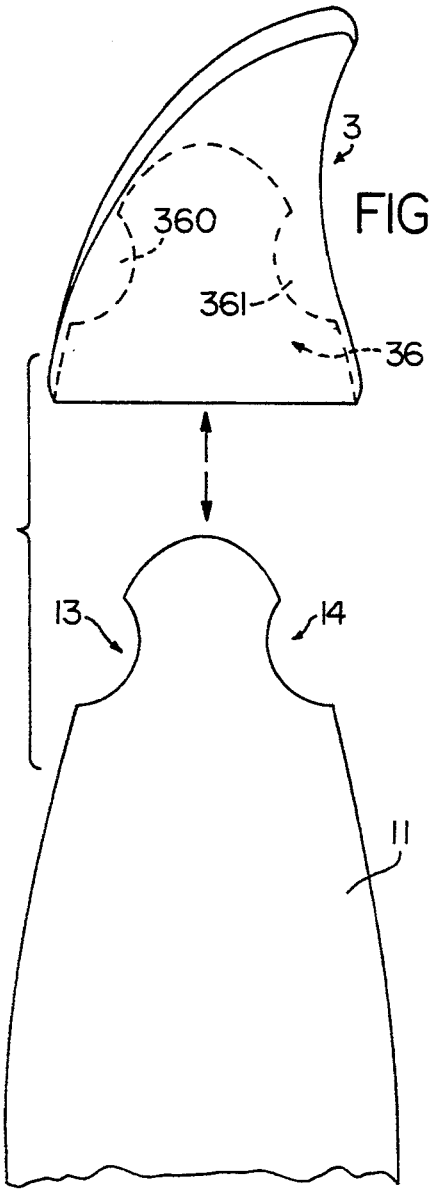
FIG. 8 is a view of a variant of the invention.

FIG. 8 illustrates an example of a method for fastening the end-piece 3 to the up-side portion 11 of the ski. The end of this portion incorporates lateral notches 13 14 and is positioned in a recess 36 having a shape matching that of the end-piece 3 comprising lateral projections 360, 361.

The end-piece can be made of a deformable plastic material such as a flexible plastic or an elastomer, in order to allow it to be forcibly fitted onto the ski. To ensure a certain degree of impact-resistance, the end-piece may be made of a plastic material filled with short glass or other fibers.

Figure 9:
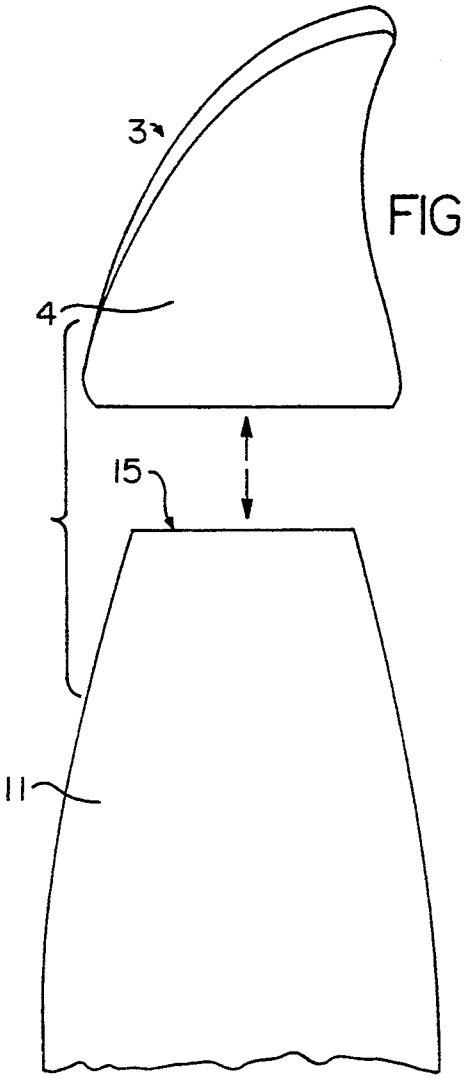
FIGS. 9 and 10 are top plan and side views respectively of another variant.
Figure 10:
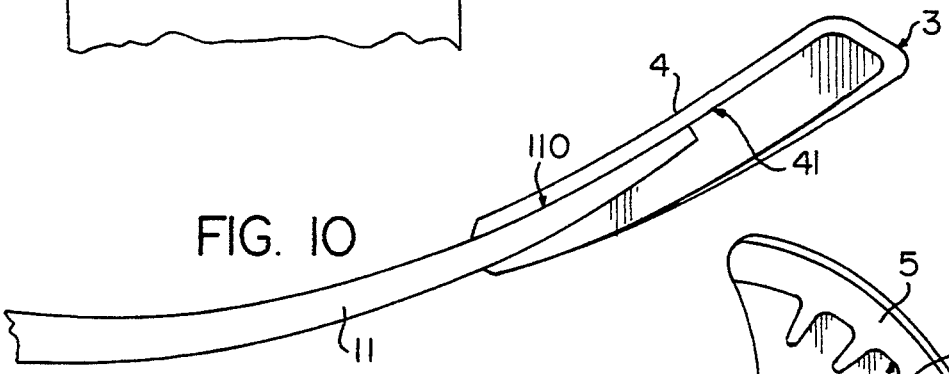

FIGS. 9 and 10 illustrate another embodiment, in which the end of the up-side end 11 is truncated and ends in a transverse edge 15. In this case, the central portion 4 may be made without a recess, and its lower surface 41 is attached to the upper surface 110 of the up-side portion 11 of the ski, using any means, e.g., screws, adhesive bonding, or rivets. The advantage gained in this particular case lies in the ability to lighten the tip of the ski, by providing an end-piece made of a material having a density less than the average density of the ski, for example.

Figure 11:
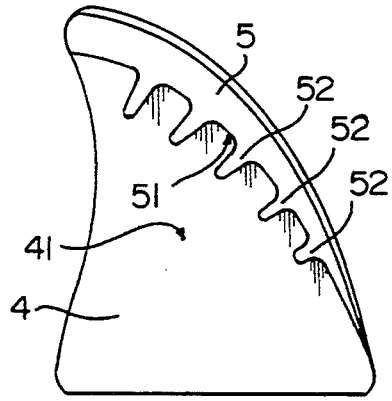
FIG. 11 is a bottom view of the tip end-piece according to an embodiment of the invention.

FIG. 11 illustrates a variant, in which the skirt 5 comprises strengthening ribs 52 which connect the lower surface 51 of the skirt to the lower surface 41 of the central portion 4.

Finally, the end-piece may be incorporated into the ski structure when the latter is manufactured, e.g., by molding.

What is claimed is:

1. Slalom slope ski, comprising an inner side, an outer side and a central down-side load-bearing portion (10) ending in a front contact line (12) beyond which is extended, in an area of a tip (2) of said ski, a raised up-side portion (11) on which is mounted an asymmetrical tip end-piece (3) which extends said raised portion by means of a central part (4) having the overall shape of a horn with an end (34) located on a longitudinal axis (II, II') offset to on inside of said ski in relation to a median longitudinal axis (I, I') of said ski, wherein said end-piece comprises an overhanging lateral part (5) connecting with said central portion and constituting a skirt for the side of an outer edge of said ski, an upper surface (50) of said skirt being adapted to come into contact with poles constituting slalom gates, and wherein said skirt (5) is so shaped that the normal line (N) marked out at any point on said upper surface (50) of said skirt forms a positive angle ($\beta$) with a plane (P) parallel to ground (S) when said ski is inclined to the outside by an angle of between 15° and 45° when the edge digs into the snow.

2. Ski according to claim 1, wherein said skirt has a width which diminishes progressively rearward, so that lateral edges of said end-piece connect substantially continuously with lateral edges of said ski.

3. Pole-deflector asymmetrical end-piece designed to be mounted on the end of a slope ski, comprising a first central part (4) having inwardly-curved sides and an overall shape of a horn having a tip (34) which falls on a longitudinal axis (II, II') offset to the inside in relation to a median longitudinal axis (I, I') of said ski; and a second lateral overhanging part (5) constituting a skirt connecting on a largest one of said inward-curved sides of said first central part (4), and wherein said skirt (5) is so shaped that the normal line (N) marked out at any point on said upper surface (50) of said skirt forms a positive angle ($\beta$) with a plane (P) parallel to ground (S) when said ski is inclined to the outside by an angle of between 15° and 45° when the edge digs into the snow.

* * * * *